US006048240A

United States Patent [19]

Damsteegt et al.

[11] Patent Number: 6,048,240

[45] Date of Patent: Apr. 11, 2000

[54] METHOD OF MANUFACTURING A CATHODE RAY TUBE

[75] Inventors: Johannes A. G. P. Damsteegt; Dirk Van Houwelingen, both of Eindhoven, Netherlands

[73] Assignee: U.S. Philips Corporation, New York, N.Y.

[21] Appl. No.: 09/185,007

[22] Filed: Nov. 3, 1998

[30] Foreign Application Priority Data

Nov. 5, 1997 [EP] European Pat. Off. ..... 97203436

[51] Int. Cl.[7] ..... H01J 9/42

[52] U.S. Cl. ..... 445/3

[58] Field of Search ..... 445/3 B

[56] References Cited

U.S. PATENT DOCUMENTS 4,952,186 8/1990 Maninger et al. ..... 445/3 B 5,176,556 1/1993 Morohashi ..... 445/3 B

*Primary Examiner*—Kenneth J. Ramsey

*Attorney, Agent, or Firm*—Robert J. Kraus

[57] ABSTRACT

To test a cathode ray tube or an apparatus comprising a cathode ray tube, a part of the electron gun is heated by means of high-frequency electromagnetic radiation. By virtue thereof, the warm-up period, that is the time which, after turning on the cathode ray tube, must elapse before the testing operation can be carried out, can be reduced, for example, from approximately 30 minutes to approximately 2 minutes.

10 Claims, 3 Drawing Sheets

METHOD OF MANUFACTURING A CATHODE RAY TUBE

BACKGROUND OF THE INVENTION

The invention relates to a method of manufacturing a cathode ray tube comprising an electron gun.

Such methods are known.

Cathode ray tubes are used, inter alia, in television receivers and computer monitors.

In a step of the method, the cathode ray tube is subjected to a test for identifying image errors and, if image errors are detected, changing the settings of the cathode ray tube.

This test consumes time and hence adds to the cost price of the cathode ray tube.

SUMMARY OF THE INVENTION

It is an object of the invention to provide a method of the type mentioned in the opening paragraph, which enables the cathode ray tube to be tested more rapidly.

To achieve this, the method in accordance with the invention is characterized in that a part of the electron gun is heated by means of high-frequency radiation, whereafter the cathode ray tube is tested.

In the known method, a cathode ray tube is turned on and tested after a waiting period in which the various parts of the cathode ray tube have reached the operating temperature, that is, after the so-called "thermal drift" is stabilized. Said period generally takes 30–50 minutes. A reduction of this waiting period (or warm-up period) saves time and hence money. A part of the electron gun may be, for example, an electrode or a number of electrodes or another metal-containing portion of the electron gun, or the electron gun as a whole.

The invention is based on the recognition that the waiting period can be reduced substantially, for example to several minutes or even less than two minutes, by heating electrodes of the gun by means of high-frequency radiation. As a result, the warm-up period is reduced substantially.

High-frequency heating also has other advantages, namely that the temperature of the electrodes can be readily adjusted, that the electrodes can be warmed up rapidly to the operating temperature, and that only metal parts, that is the electrodes, are heated.

Preferably, a high-frequency coil is arranged around the gun, a position of said coil close to the so-called G2 electrode being very advantageous.

These and other aspects of the invention will be apparent from and elucidated with reference to the embodiments described hereinafter.

BRIEF DESCRIPTION OF THE DRAWING

In the drawing.

The Figures are not drawn to scale. In the Figures, like reference numerals generally refer to like parts.

DESCRIPTION OF THE PREFERRED EMBODIMENT

Figure 1:
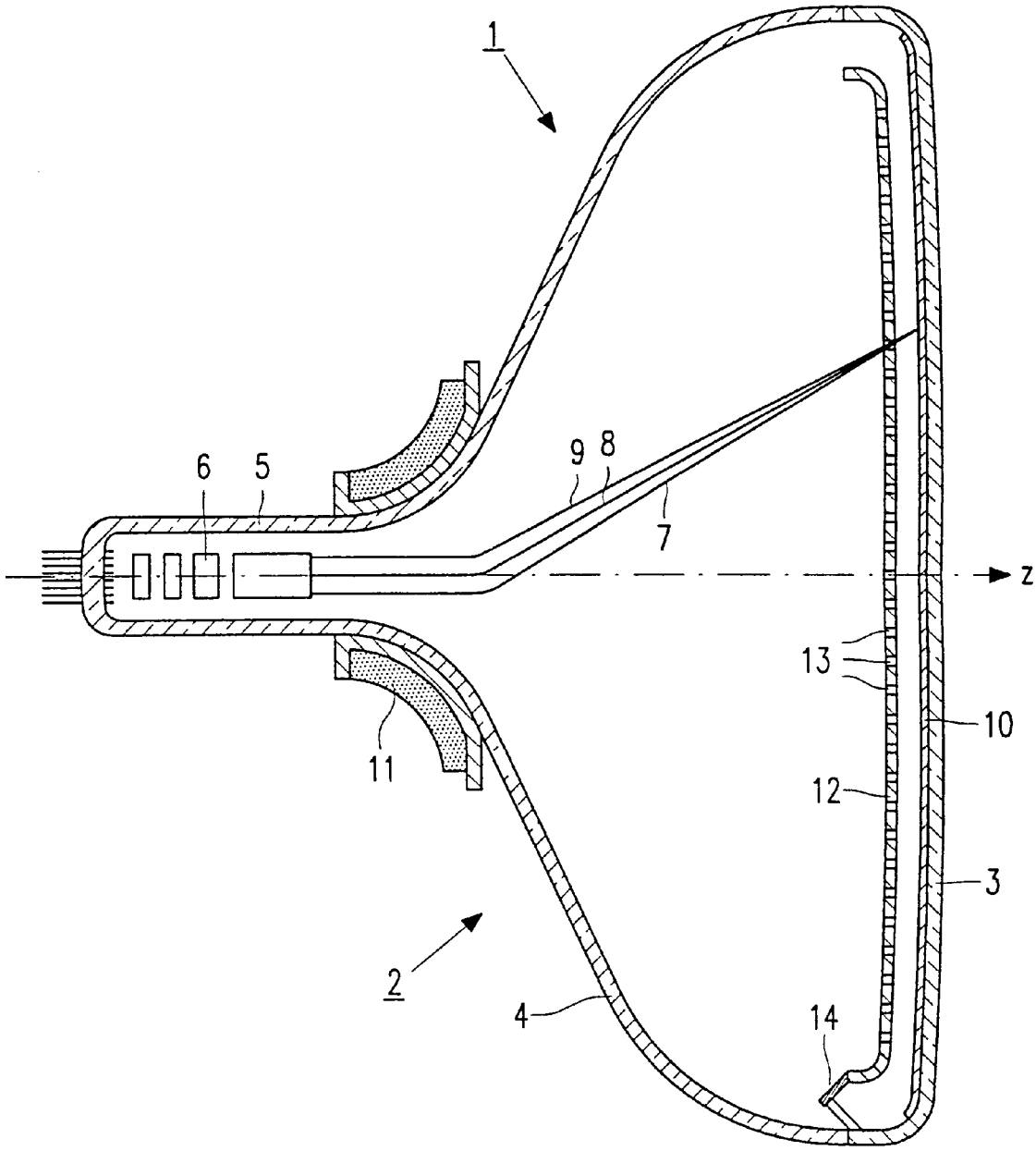
FIG. 1 shows a display device.

A color display device 1 (FIG. 1) comprises an evacuated envelope 2 with a display window 3, a cone portion 4 and a neck 5. Said neck 5 accommodates an electron gun 6 for generating three electron beams 7, 8 and 9. A display screen 10 is situated on the inside of the display window. Said display screen 10 comprises a phosphor pattern of phosphor elements luminescing in red, green and blue. On their way to the display screen, the electron beams 7, 8 and 9 are deflected across the display screen 10 by means of a deflection unit 11 and pass through a shadow mask 12 which is arranged in front of the display window 3 and which comprises a thin plate with apertures 13. The shadow mask is suspended in the display window by means of suspension means 14. The three electron beams converge and pass through the apertures of the shadow mask at a small angle relative to each other and, consequently, each electron beam impinges on phosphor elements of only one color.

Figure 2:
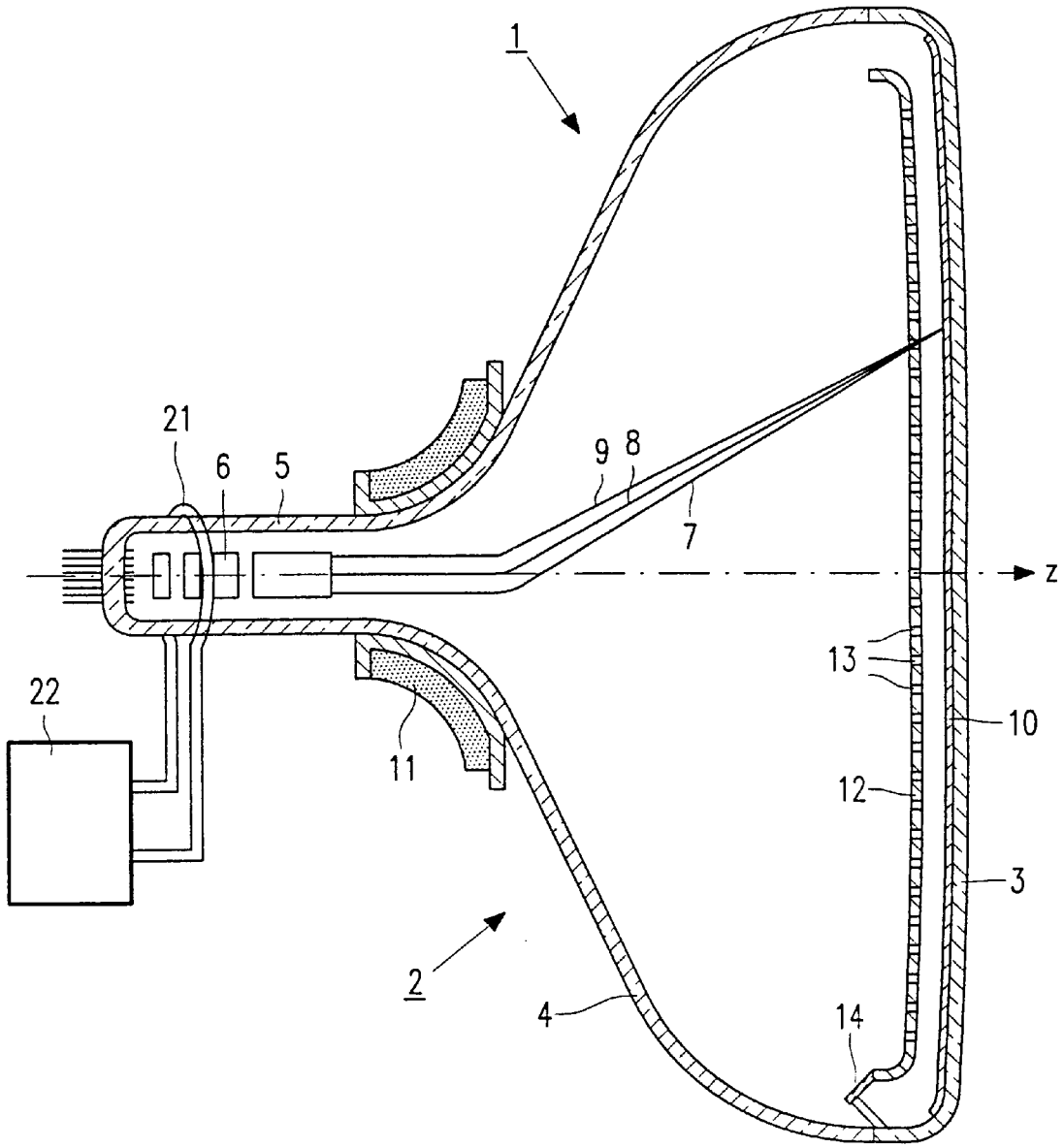
FIG. 2 illustrates the method in accordance with the invention.

FIG. 2 illustrates the method in accordance with the invention. Around the neck 5, there is provided a high-frequency coil 21 which, in operation, is connected to a high-frequency generator 22, for example a Himmelwerk generator Type HU-2 (water-cooled). In this example, the coil 21 has a single winding with an inside diameter of 32 mm. In this example, the coil is preferably arranged so as to be approximately coplanar with the re-focusing portion (the G1, G2 and G3-electrodes) of the electron gun 6. In an experimental set-up, a high-frequency field with a frequency of 48 kHz was generated at a power of 0.9 kilowatt for 4 seconds. Preferably, the frequency of the high-frequency electromagnetic radiation lies in the range of 20–100 kHz. At a higher frequency, reasonably large temperature differences locally occur (for example at the edges of electrodes), which may cause thermal stresses. At a lower frequency, a relatively large part of the electron gun is warmed up.

Figure 3:
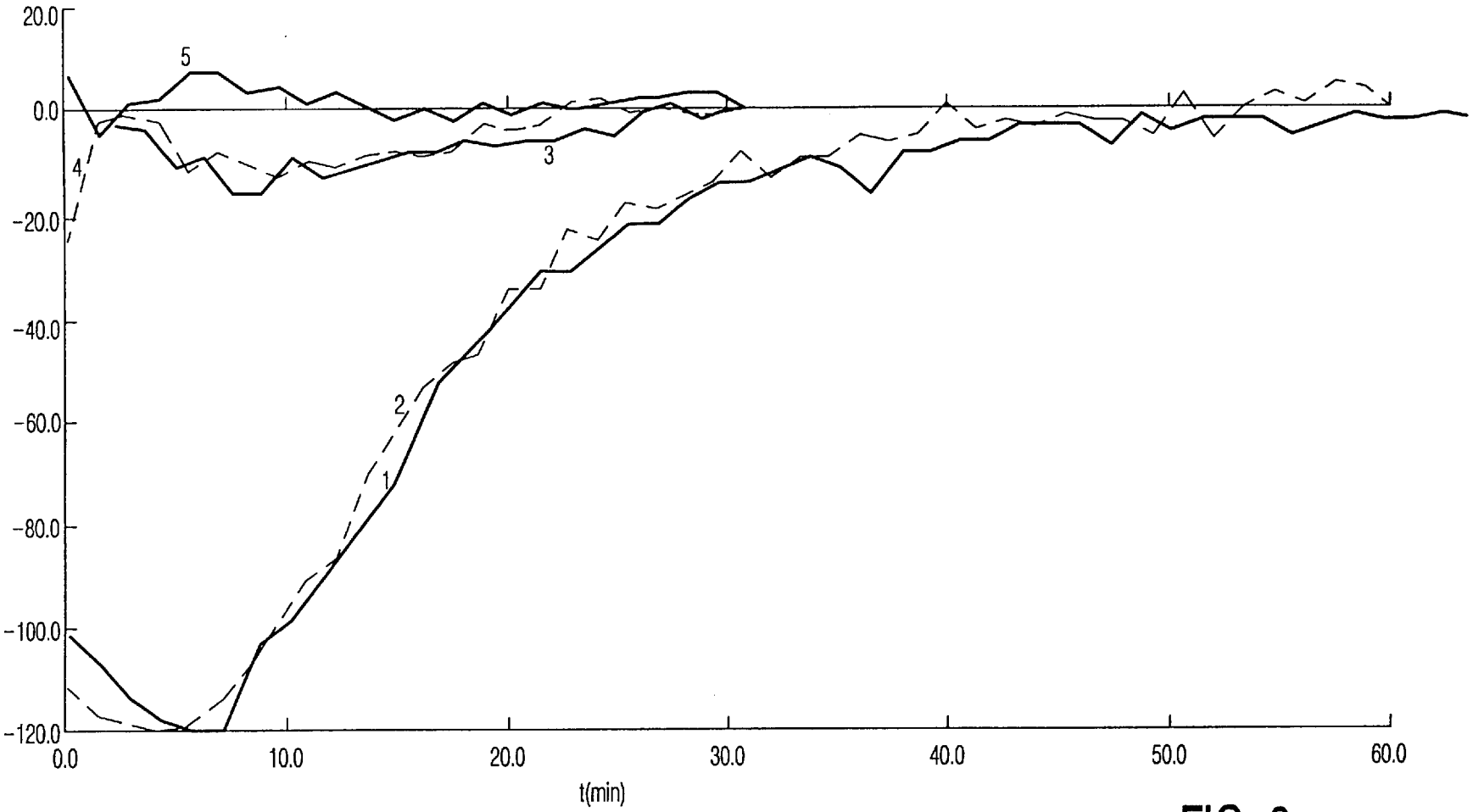
FIG. 3 graphically shows thermal drift in combination with and not in combination with the method in accordance with the invention.

FIG. 3 graphically shows the result achieved by employing,or not employing, the method in accordance with the invention. In said graph, the so-called thermal drift (in micrometers) is plotted as a function of time after turning on the cathode ray tube. Thermal drift is a phenomenon which causes an electron beam to be displaced on the display screen as a result of warm-up of the cathode ray tube. The thermal drift plotted in the Figures is a measure of the displacement of the two outermost electron beams relative to the central electron beam on the display screen (measured in micrometers) of a cathode ray tube comprising an in-line electron gun. Such displacements cause color errors. If the displacements no longer occur, the thermal drift is equal to zero. An important step in the method of manufacturing a cathode ray tube is the adjustment of a cathode ray tube, whereby a number of adjustable quantities (such as voltages on the electrodes of a cathode ray tube or the currents through the deflection unit) are set such that the picture quality obtained meets the required standards. Curves 1 and 2 of FIG. 3 show the thermal drift, after turning on the cathode ray tube, in known methods. Only after approximately 30–40 minutes, the position of electron beams on the screen is no longer subject to thermal drift (displacements no longer occur) and adjustable quantities of the cathode ray tube can be set. This "waiting time", however, costs money and space. Curves 3, 4 and 5 show thermal drift in the method in accordance with the invention. In this example, a coil is arranged around the neck of the cathode ray tube, approximately at the location of the G2–G3 electrodes, whereafter a heating operation is carried out for 4 seconds (in the manner described hereinabove). Subsequently, the cathode ray tube is turned on. After a waiting time of not more than 2 minutes, the thermal drift is comparable to that obtained after a waiting time of 30–40 minutes in curves 1 and 2. Since the waiting time can be reduced, time (and hence money) is saved. The position of the heating coil (and hence of the portion of the electron gun that is being heated) is important in this respect. The effect decreases as the distance between the heating coil and the G2 electrode increases, that is, the necessary waiting period increases.

It will be obvious that the method in accordance with the invention is not limited to the above example. For example, the frequency of the supply current of coil 21 can be varied, as can the time during which the coil is activated. The coil may comprise more than one winding. During testing, the coil does not have to be arranged around the neck of the tube. In a preferred embodiment, there may be a short time period (for example 1 minute) between high-frequency heating and turning-on of the cathode ray tube. As a result of said high-frequency heating, (a portion) of the electron gun is heated. Since the electron gun is situated in a vacuum and there is little thermal contact between the electron gun and other parts of the cathode ray tube, the temperature of the heated (portion of the) electron gun remains constant. By virtue thereof, the heating coil can be removed after it has been used and the cathode ray tube can be furnished with the necessary connections, whereafter said cathode ray tube is activated. The drawings show a method of manufacturing a cathode ray tube. Cathode ray tubes are tested as described hereinabove. Apparatuses comprising cathode ray tubes, such as television receivers or computer monitors, are also tested in the course of their manufacture, and also such tests cannot be carried out until there is substantially no, or only little thermal drift. The invention also relates to a method of manufacturing an apparatus comprising a cathode ray tube, and is characterized in that a part of the electron gun is heated by means of high-frequency radiation.

What is claimed is:

1. A method of manufacturing an apparatus including a cathode ray tube comprising an evacuated envelope containing a luminescent screen and an electron gun situated in a neck portion of the envelope for, in operation, generating a plurality of electron beams for deflection across the screen to produce an image, said method including:

a) applying high-frequency heating radiation to preferentially heat at least one electrode of the electron gun;

b) applying electrical power to the cathode ray tube;

c) after thermal drift of the electron beams has decreased to a predetermined magnitude, testing the cathode ray tube to identify image errors.

2. A method as in claim 1 where the high-frequency heating radiation is applied by arranging a coil around the neck portion of the envelope.

3. A method as in claim 2 where the coil is arranged to heat at least one pre-focusing electrode of the electron gun.

4. A method as in claim 3 where the at least one pre-focusing electrode comprises a G2 electrode.

5. A method as in claim 1 where the frequency of the high-frequency heating radiation lies in the range of approximately 20–100 kHz.

6. A method of manufacturing an apparatus including a cathode ray tube comprising an evacuated envelope containing a luminescent screen and an electron gun situated in a neck portion of the envelope for, in operation, generating a plurality of electron beams for deflection across the screen to produce an image, said method including:

a) disposing a high-frequency radiation apparatus around the neck portion of the cathode ray tube to preferentially heat at least one electrode of the electron gun;

b) applying electrical power to the cathode ray tube;

c) after thermal drift of the electron beams has decreased to a predetermined magnitude facilitating testing, testing the cathode ray tube to identify image errors.

7. A method as in claim 6 where the high-frequency heating radiation is applied by arranging a coil around the neck portion of the envelope.

8. A method as in claim 7 where the coil is arranged to heat at least one pre-focusing electrode of the electron gun.

9. A method as in claim 8 where the at least one pre-focusing electrode comprises a G2 electrode.

10. A method as in claim 6 where the frequency of the high-frequency heating radiation lies in the range of approximately 20–100 kHz.

* * * * *